United States Patent [19]

Stewart et al.

[11] 4,094,808

[45] June 13, 1978

[54] SOLUBILITY STABLE ENCAPSULATED DIPERISOPHTHALIC ACID COMPOSITIONS

[75] Inventors: Dorothy A. Stewart, Pittsburgh, Pa.; Bobby D. Ricketts; Charles H. Hoelscher, both of Corpus Christi, Tex.

[73] Assignee: PPG Industries, Inc., Pittsburgh, Pa.

[21] Appl. No.: 788,877

[22] Filed: Apr. 19, 1977

Related U.S. Application Data

[63] Continuation of Ser. No. 632,923, Nov. 18, 1975, abandoned, which is a continuation-in-part of Ser. No. 360,858, May 16, 1973, abandoned.

[51] Int. Cl.[2] ..... C11D 3/395; C11D 7/54

[52] U.S. Cl. ..... 252/186; 252/95; 252/103; 252/316; 252/363.5; 252/DIG. 11; 427/213

[58] Field of Search ..... 252/316, 95, 186, 351, 252/363.5; 424/16, 19; 427/213

[56] References Cited

U.S. PATENT DOCUMENTS

| | | | |
|---|---|---|---|
| 2,990,334 | 6/1961 | Graham | 424/37 |
| 3,346,502 | 10/1967 | Wixon | 252/95 X |
| 3,494,786 | 2/1970 | Nielsen | 427/213 X |
| 3,494,787 | 2/1970 | Lund et al. | 427/213 |
| 3,622,366 | 11/1971 | Piester | 252/95 X |
| 3,630,929 | 12/1971 | van Dijk | 252/363.5 X |
| 3,655,738 | 4/1972 | Nielsen | 260/502 R |
| 3,880,914 | 4/1975 | Nielsen | 260/502 R |

*Primary Examiner*—Richard D. Lovering
*Attorney, Agent, or Firm*—Edward J. Whitfield; Mark Levin

[57] ABSTRACT

Disclosed is a solubility stable bleaching formulation in the form of an encapsulated core. The core comprises particles of tabular habit diperisophthalic acid (DPI) in admixture with particles of inorganic salt substantially more water-soluble than the diperisophthalic acid. The bleaching formulation maintains a high rate of solution in water after storage under conditions of temperature fluctuation.

4 Claims, 3 Drawing Figures

SOLUBILITY STABLE ENCAPSULATED DIPERISOPHTHALIC ACID COMPOSITIONS

RELATED APPLICATION

This is a continuation of application Serial No. 632,923, filed Nov. 18, 1975, and now abandoned, which is a continuation-in-part of Ser. No. 360,858, filed May 16, 1973, now abandoned.

BACKGROUND OF THE INVENTION

Bleaching formulations comprising encapsulated organic peracids are known. For example, Nielsen et. al. disclose in U.S. Pat. No. 3,494,787 a dry composition of matter having a core of perphthalic acid and an encapsulating layer of a hydrated water-soluble salt. The encapsulating layer prevents contact of the core with materials (e.g., alkalis) which cause its decomposition.

Inert salt diluents have been suggested for inclusion in the encasing layer of granulated compositions having cores containing perphthalic acids or perphthalic acids with inert diluents, viz., peracids admixed with peracid decomposition products (see U.S. Pat. No. 3,494,786 issued to D. R. Nielsen). While the presence of inert salt diluents in the encasing layer is effective in increasing the solution rate of the encasing layer, their presence does not appreciably increase the rate of solution of the less soluble core. An undesirable feature of slow core dissolution is that localized high concentrations of bleaching agent during laundering may be produced due to entrapment of solid particles in folds of cloth which may result in localized overbleaching and production of white spots on colored goods.

Diperisophthalic acid (DPI) has been described as having two different crystal forms defined by characteristic X-ray diffraction powder pattern spacings (see U.S. Pat. No. 3,880,914 issued to D. R. Nielsen, which disclosure is incorporated herein by reference). Each crystal form of DPI has a symmetry of structure which is usually associated with an external symmetry or "habit." The habits of DPI have been identified and designated as "tabular" and "acicular." The tabular habit DPI is characterized by a shape having two approximately equal dimensions with the third dimension about one-fifth to one-third the other dimensions. This habit is in contrast to the acicular (needlelike) habit DPI crystal having a typical length to diameter ratio of over 20.

U.S. Pat. No. 3,655,738 issued to D. R. Nielsen teaches a method of preparing tabular form DPI. In addition, our copending application Ser. No. 633,184, filed Nov. 19, 1975, now U.S. Pat. No. 4,052,443, discloses that water slurries of tabular habit DPI are formed or maintained by heating DPI slurry above about a temperature of 67° C.

A method of increasing the dissolution rate of organic peracid cores in encapsulated formulations is needed.

SUMMARY OF THE INVENTION

The present invention is an organic peracid formulation in the form of an encapsulated core having a high rate of solution in aqueous media. The core comprises particles of a solid organic peracid in admixture with particles of a material substantially more water-soluble than the organic peracid as dispersing agent. The core is essentially completely encapsulated with a water dispersible encapsulating material capable, in the absence of free water, of preventing contact of the peracid with substances which cause its decompositions, e.g., alkalis. Water dispersible encapsulating agents are those materials which distribute when placed in water either by dissolution or otherwise.

Within the general teaching of this invention is the preferred embodiment of an organic peracid formulation having a high rate of solution in aqueous media which rate of solution is not appreciably reduced by exposure of the formulation to temperature fluctuations, especially the transition from ambient to above-ambient temperatures. It is an unexpected discovery that bleaching formulations having acicular habit DPI containing cores may under the influence of temperature fluctuation lose their fast dissolving or dispersing properties despite the copresence of dispersing agent within the peracid core.

This invention additionally teaches a process for making a bleaching formulation having a high rate of solution in aqueous media which rate of solution is not appreciably reduced by exposure of the formulation to temperature fluctuations.

DESCRIPTION OF PHOTOMICROGRAPHS

DETAILED DESCRIPTION OF THE INVENTION

Figure 1:
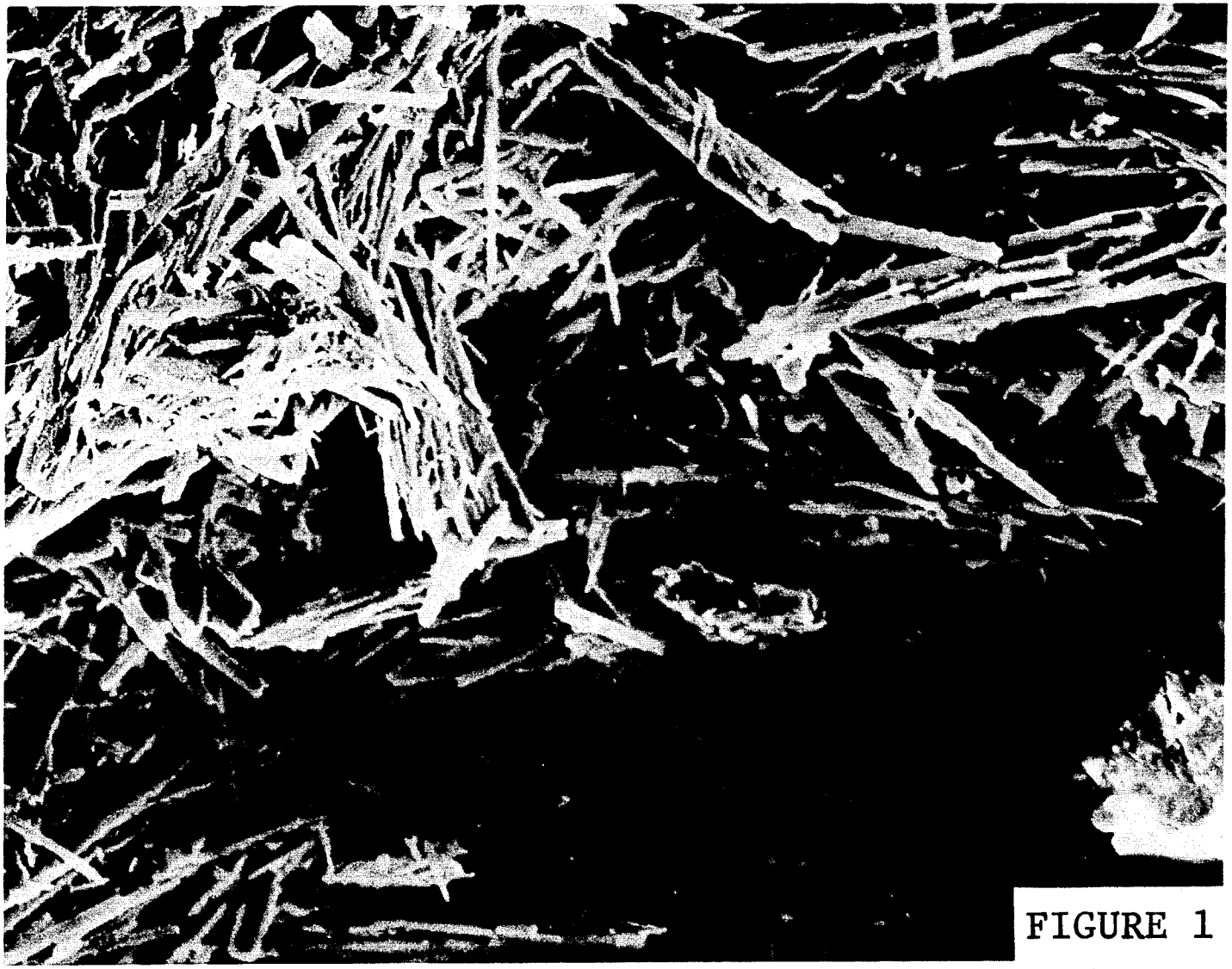
FIG. 1 is a scanning electron photomicrograph of a core particle containing acicular habit DPI at a magnification of 2000 diameters.

The bleaching formulations of this invention have a form with the elements of (1) an organic peracid containing core, and (2) a water dispersible encapsulating layer surrounding said core.

The core of the bleaching formulation has as essential ingredients (1) organic peracid and (2) dispersing agent.

Organic peracids containing greater than 3 weight percent active oxygen are preferred. Those organic peracids useful in the present invention include aliphatic peracids, alicyclic peracids and aromatic peracids. Examples of such acids are diperadipic acid, diperazelaic acid, cyclohexyl dipercarboxylic acid, cycloheptyl dipercarboxylic acid, cyclooctyl dipercarboxylic acid, perbenzoic acid, paranitro perbenzoic acid and metachloro perbenzoic acid. Typically, perphthalic acids such as mono- and di- perphthalic, perisophthalic and perterephthalic acid are employed with diperisophthalic acid being the preferred species. The diperisophthalic acid may be either tabular habit or acicular habit. The formulation of the present invention is especially useful when the peracid is only sparingly soluble in water, i.e., less than about 3 percent by weight. If desired, more than one organic peracid may be used, for example, a mixture of DPI and diperazelaic acid.

The dispersing agent may be one or a mixture of materials which are substantially more soluble in water than is the peracid. By "substantially more soluble" in water is meant having at least twice and preferably five times the solubility in water at 15° C. Those compositions which dissolve in water to the extent of at least 1 gram per 100 grams of water at 15° C. are useful as dispersing agents. Those agents soluble in water to the extent of 4 to 200 grams per 100 grams of water at 15° C. are preferred. The core particle containing the peracid and dispersing agent may contain from about 1 to about 90 percent by weight of the dispersing agent. Typically, the core will contain from 2 to 75 percent dispersing agent with an amount of from 5 to 60 percent being preferred. Ionic dispersing agents usable in the core include one or a mixture of hydrates of inorganic salts such as hydrates of sodium acetate, sodium monobasic phosphate, sodium dibasic phosphate, sodium sulfate, sodium potassium tartrate, sodium acid tartrate, magnesium acetate, magnesium ammonium sulfate, aluminum nitrate, aluminum sulfate, aluminum magnesium nitrate, potassium benzoate, magnesium sulfate, potassium magnesium sulfate and sodium aluminum sulfate. Other hydrated salts which retain their water of hydration below 30° C. but give up at least part of such water of hydration below 150° C. are equally useful. Nonhydratable salts may also be employed as the dispersing agent. Useful non-hydratable salts include potassium sulfate, potassium hydrogen sulfate, potassium dihydrogen phosphate, potassium acid phthalate, sodium chloride, sodium nitrate and ammonium acid sulfate. A nonhydratable salt may be used in combination with a hydrated salt in order to provide a composition having releasable water of hydration in the core to minimize the danger of hazardous decomposition.

A core composition is prepared by combining particles of the organic peracid with particles of dispersing agent. Preferably the organic peracid and dispersing agent are admixed in a manner such that they are evenly dispersed with each other. The mixing of organic peracid and dispersing agent is advantageously performed in an aqueous media.

The water dispersible encapsulating layer surrounding the core is a substance which in the absence of free water prevents the core's contact with substances capable of causing decomposition of the contained peracid. In a preferred embodiment the encapsulating layer contains a hydrated salt which retains water of hydration below 30° C., but gives up at least part of its water of hydration below the decomposition temperature of the peracid. Those hydrated salts which give up at least part of their water of hydration below 150° C. and typically below 120° C. are useful.

Hydratable inorganic salts in less than their maximum state of hydration (e.g., $MgSO_4 \cdot H_2O$) are preferred materials to form the encapsulating layer. When a nonhydrated salt is used as the encapsulating material, a binding agent capable of forming a gel when contacted with water is normally combined with the salt. Use of a binding agent provides a more cohesive coating than would be obtained with the salt alone. Binding agents which may be mixed with encapsulating salt in order to provide a cohesive coating include magnesium aluminum silicate, polyvinyl alcohol, soluble starch, hydroxy propyl cellulose, hydroxyethyl cellulose, polyvinylpyrrolidone, casein, zein and agar.

In another embodiment of the invention, the peracid core is encapsulated with a water dispersible organic material such as polyvinyl alcohol, soluble starch, gelatin or carboxymethyl cellulose. Such encapsulation is normally accomplished by contacting the core particles with the organic material in the liquid state such as by spraying or dipping the particles into the liquid.

In another embodiment of the invention, the dispersing agent is an acidic, neutral, or weakly basic detergent builder. Examples of detergent builders which are compatible with the organic peracids useful in the present invention include citric acid, mellitic acid, pyromellitic acid, maleic acid, diglycolic acid, oxydisuccinic acid, nitrilotriacetic acid, ethylene diaminetetraacetic acid, polyacrylic acid, cyclopentane-1,2,3,4-tetracarboxylic acid and tetrahydrofuran-2,3,4,5-tetracarboxylic acid. In combination with the peracid bleach these compositions serve the dual purpose of increasing the rate of dissolution of the peracid as well as sequestering hardness causing ions in the wash solution.

Examples of other organic acids which may be employed as the dispersing agent include oxalic acid, malic acid, 1,3-cyclobutenedicarboxylic acid, glutaric acid, maleic acid, and malonic acid.

Whereas the hydratable salts referred to in the preceding paragraph are preferred for formation of the encapsulating layer, it is also within the scope of this invention to use non-hydratable salts such as those which have been previously named as having utility in the core composition. Alternatively, a non-hydrated salt may be combined with the organic peracid.

The same materials may be used as both dispersing agent for the core and water dispersible agent for the encapsulating layer. This dual use applies particularly to the selection of hydratable salts hereinbefore described as useful in the practice of this invention. It is desirable that the combined presence of hydrated salt in the core and encapsulating layer be sufficient to provide at least 0.1 part by weight water of hydration per part by weight of organic peracid.

Preparation of the Encapsulated Core Bleaching Formulation

The core particles can be prepared by dissolving in or mixing the dispersing agent with a water slurry of the peracid. After addition of the dispersing agent, the mixture is normally blended to provide even distribution of the dispersing agent and peracid particles. After mixing, the slurry is converted into core particles. One method for preparation of cores is to convert the slurry into a thin sheet and freeze it. The frozen sheet is then broken into particles of the desired size. An alternative method for providing solid aqueous peracid particles involves subdividing the peracid slurry into fine particles. This may be accomplished by feeding the slurry through a spray nozzle or atomizing device to form liquid droplets. The liquid droplets may be contacted with an inert liquid coolant such as liquid nitrogen to cause their soldification. Other methods of producing the core particles include extrusion through a die and pelletizing. Depending on the thickness of the slurry, the particles need not be frozen. However, frozen particles are conveniently handled as is disclosed in U.S. Pat. No. 3,622,366. The peracid core particles are then contacted with fine particles of a material which will comprise the composition of the protective encapsulating coating. The encapsulating material will normally by a hydratable salt or a non-hydratable salt in combination with a binding agent. During encapsulation with a hydratable salt, the salt is in an incompletely hydrated state, preferably in a substantially unhydrated form so that is is capable of taking up water from the core particles as water of hydration. For example, magnesium sulfate per se or magnesium sulfate monohydrate may be the encapsulating salt while the coating may consist of a hydrated magnesium sulfate composition with from 1 to 7 moles of water per mole of magnesium sulfate.

Figure 2:
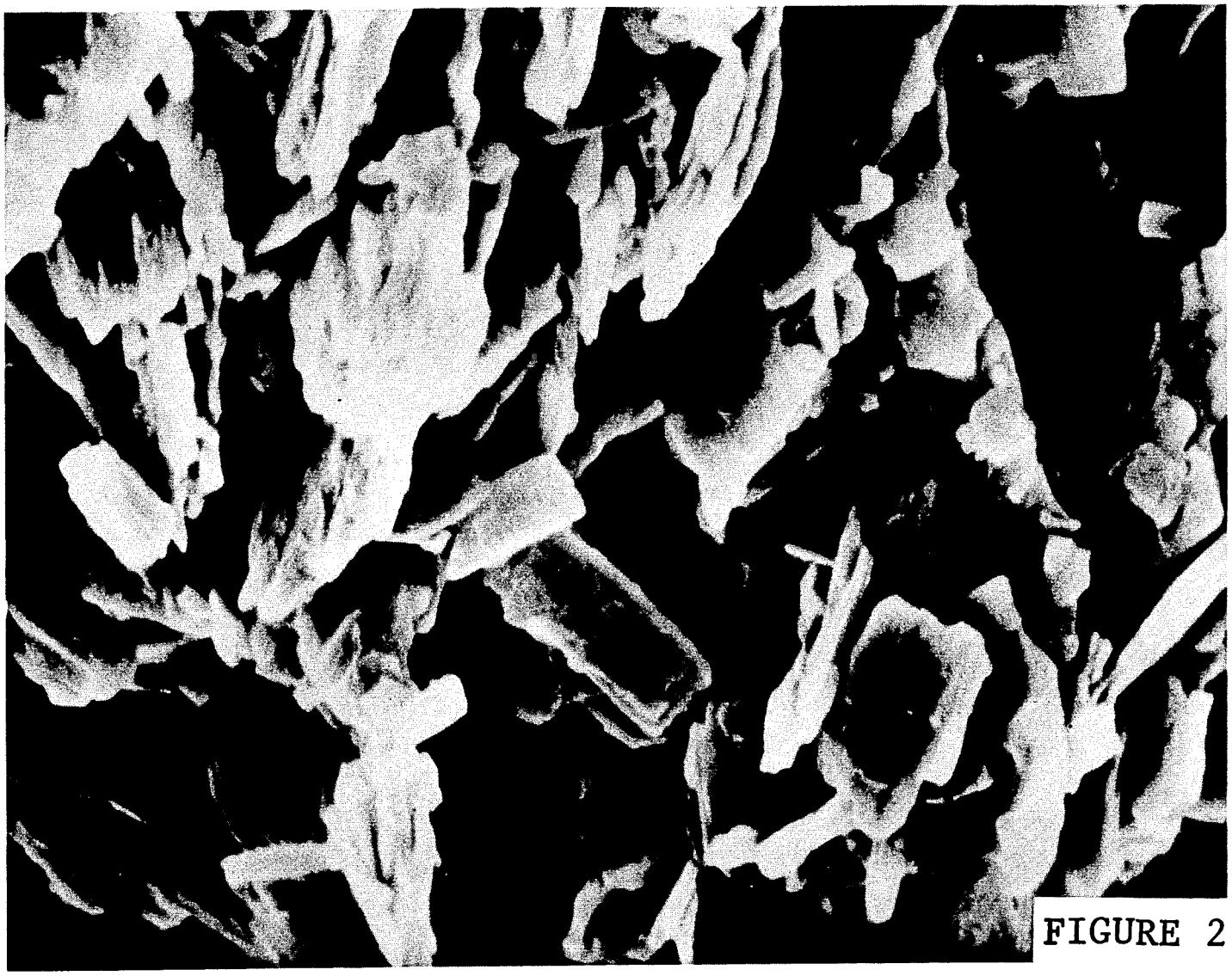
FIG. 2 is a scanning electron photomicrograph of a core particle containing tabular habit DPI at a magnification of 10,000 diameters.
Figure 3:
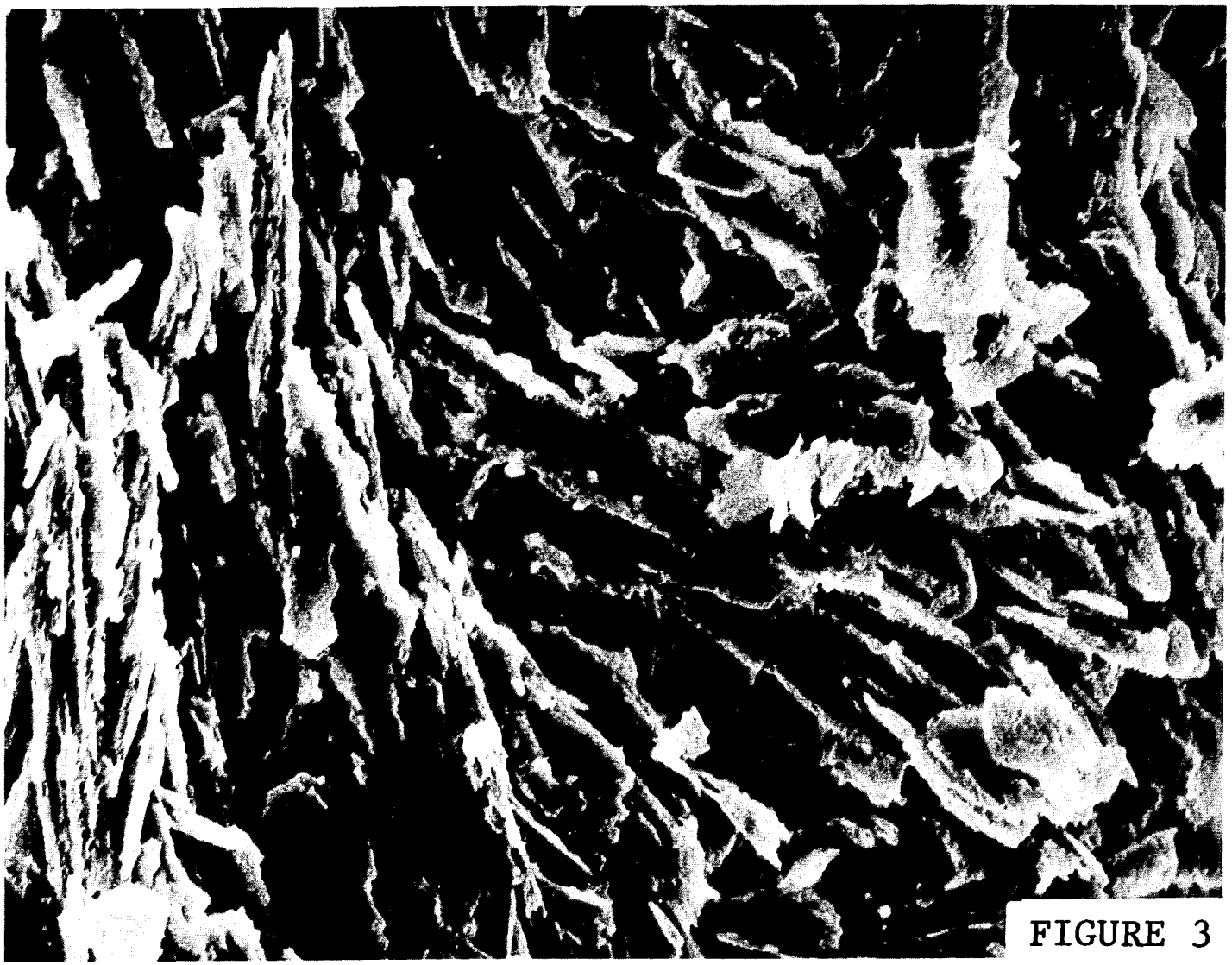
FIG. 3 is a scanning electron photomicrograph of a core particle originally in acicular habit which was heat treated to change to tabular form. Magnification is 4000 diameters.

Bleaching formulations having an encapsulated core containing DPI of acicular habit and form are shown by X-ray powder pattern analysis to undergo a physical change to tabular form upon exposure to temperatures of 35° C. for a period of days or even hours. A core particle containing acicular habit DPI (and $MgSO_4$ dispersing agent) is shown in photomicrograph FIG. 1. A core particle containing tabular habit DPI (and $MgSO_4$ dispersing agent) is shown in photomicrograph FIG. 2. Without being bound by any mode of operation, it is theorized that in the environment of the encapsulated core the change from acicular form to tabular form induced by exposure to increased temperature gives a hybrid "welded" DPI crystal habit. This welded habit of tabular form DPI is shown in the photomicrograph labeled FIG. 3 and is associated with poor solubility rates, (despite the presence of $MgSO_4$ dispersing agents). It is necessary to have tabular habit DPI originally present in the core at the time the bleaching formulation in the form of an encapsulated core is formed to avoid the crystal change of acicular DPI.

When encapsulated compositions of DPI having solubility characteristics insensitive to temperature fluctuation are desired, they may be prepared by heating a slurry of DPI at about 67° C. to assure formation or maintenance of tabular habit DPI. Dispersing agent may be admixed with the slurry before or after the heating operation. Thereafter, slurry particles may be made by one of the above-described methods and encapsulated with a water dispersible encapsulating material such as a hydratable salt.

The core particles may be contacted with the encapsulating material in a static bed, but contact is preferably carried out in a dynamic system. Ideally, the aqueous peracid particles are contacted in a bed of fluidized finely-divided salt particles. Inert gases such as nitrogen and air are effective fluidizing agents. Thus, a bed of hydratable salt or non-hydratable salt in combination with a binding agent is suspended in a rising stream of inert gas. The core particles are then fed into the upper part of the bed. Water available from the aqueous particles appears in the coating of encapsulating particles as water of hydration when a hydratable salt is used and water of gelation when a non-hydratable salt and binding agent combination is used as the encapsulating material. Of course, when the core particle is frozen, the temperature of the fluidizing gas is above 0° C.

Hydratable organic compounds are applied in a manner similar to the hydratable inorganic salts and non-hydratable organics are applied to the core as are the non-hydratable inorganic salts.

The dispersing agent may be the same salt as that used for the coating since the only criteria are that the dispersing agent be compatible with and more readily soluble in water than the peracid. Thus, encapsulated particles of peracid which are either too large or too small for the desired purpose can be reused economically in the core preparation. This is accomplished by reslurrying the oversized and undersized particles and forming core particles from the slurry as previously described. These core particles, which already contain the dispersing agent, i.e., the material which was formerly the encapsulating material, can be re-encapsulated with a protective coating.

In another embodiment of the invention, the dispersing agent is a double salt. Such double salts may be formed by adding two salts to the peracid in relative proportions favorable to formation of the double salt. This embodiment is advantageous when the double salt has desirable characteristics possessed by neither of the salts by itself. For example, $Na_2Mg(SO_4)_2 \cdot 4\ H_2O$ formed in the core by slurrying the peracid particles with $Na_2SO_4$ and $MgSO_4$ in a 10:1 ratio is an especially desirable dispersing agent. The double salt contains water of hydration to act as a heat sink. The double salt is preferred over $Na_2SO_4$, which contains no magnesium ion, due to its formation, under similar conditions, of a smaller crystal which may be more evenly distributed throughout the peracid particles in the core than is a crystal of $Na_2SO_4$.

The encapsulated cores will normally range in size from 0.1 to 5 millimeters in diameter and preferably from 0.2 to 2 millimeters. The protective shell will normally average at least 0.05 millimeter and preferably from 0.1 to 1.0 millimeters thick. The core will preferably have a diameter of from 0.05 to about 5 millimeters. The dispersing agent, which is embedded within a matrix of the peracid, will usually have a particle size of from 0.001 to 1 millimeter and preferably from 0.005 to 0.5 millimeter.

While a perfectly continuous completely encapsulating shell is preferred, products which are less perfectly encapsulated, but essentially completely encapsulated, may be admixed with alkaline synthetic detergents without unacceptable decomposition of the peracid.

In general, the dispersing agent will be an ionic material. Due to the incompatibility of peracids with alkaline materials, acids and salts which are acidic, neutral or mildly basic are preferred. Those ionic compositions whose 1 percent water solutions have a pH below 9.0 and preferably a pH from 2 to 8 are employed as dispersing agent.

The invention is further illustrated by the following examples.

EXAMPLE I

Diperisophthalic acid slurries containing less than 5 percent isophthalic acid were made by dissolving the salt to be used as dispersing agent in deionized water in an amount sufficient to yield the desired concentration of salt when the solution was slurried with a wet cake of diperisophthalic acid. The resulting slurries were homogenized in an electric blender, formed into thin layers between sheets of polyethylene, and quick frozen at dry ice temperatures. The frozen sheets were broken up, ground, and screened to −18 +70 mesh frozen cores. An encapsulating material was prepared by mixing $Na_2SO_4$ and $MgSO_4 \cdot 1\ H_2O$ in ratios of from 1:1 to 9:1. The frozen core particles were encapsulated by contacting them with the salt particles in a heated 3 inch diameter fluid bed. Heated air was used as the fluidizing gas to maintain the temperature at 40° to 45° C. After a retention time of approximately 15 minutes, the bed contents were screened for 2 minutes on 8 inch diameter screens mounted on a Ro-tap sieve shaker at a loading of approximately 250 grams. A product consisting of particles ranging in size from −14 to 30 60 mesh was collected. The samples prepared in this manner, as well as samples of encapsulated diperisophthalic acid containing no dispersing agent, were subjected to dissolution rate studies at 50° C and 20° C.

Dissolution rates were determined as follows:

A simulated wash solution was prepared by dissolving 0.15 percent by weight of a household detergent in tap water. For each test, a 250 milliliter portion was placed in a 400 milliliter beaker on a temperature adjusted stirring hot plate, or in a temperature adjusted cooling bath, with a constant stirring rate provided by a magnetic stirring bar. A quantity of encapsulated diperisophthalic acid sufficient to yield a solution containing 60 parts per million active oxygen was added to the solution and stirred for a given length of time. At the end of the stirring period, the entire solution was quickly filtered through a Buchner funnel and into a flask containing approximately 250 milliliters of 4.3 percent $H_2SO_4$. The wet filter paper and any residue were added to another flask containing equal amounts of isopropanol and 4.3 percent $H_2SO_4$ to dissolve any solids. Both solutions containing the filtrate and the solids were then analyzed for diperisophthalic acid by titration with a $Na_2S_2O_3$ solution. The procedure was repeated for each of several time periods at 50° and 20° C. Table 1 sets out the dissolution rates of encapsulated diperisophthalic acid with and without the presence of additives in the cores.

$Na_2SO_4$ and $H_2O$ accounting for 20.7, 39.1 and 12.6 weight percent of the capsules, respectively.

Ordinary city tap water containing 0.15 percent of a commercial detergent was used to determine dissolution rates. For each test a 250 milliliter portion of the test solution was placed in a 400 milliliter beaker and the temperature controlled to 20° or 50° C. with stirring provided by a magnetic stirring bar.

A quantity of the encapsulated diperisophthalic acid being tested sufficient to yield a solution containing 60 parts per million active oxygen was added to the beaker and stirred for the requisite length of time. The amount of diperisophthalic acid dissolved in a given period of time was determined as in Example I.

The relative dissolution rates of diperisophthalic acid alone and diperisophthalic acid containing the dispersing agent are graphically set out in the drawing. From the drawing, it can be determined that the diperisophthalic acid sample containing the dispersing agent dis-

TABLE I

Comparison of Dissolution Rates of Encapsulated Diperisophthalic Acid With and Without Core Additives

| Dispersing Agent Added To Core | Composition, Basis Encapsulated Product Weight: In Core[1] % Dispersing Agent | % DPI[2] | % IPA[3] | In Coating % $MgSO_4$ | % $Na_2SO_4$ | % $H_2O$ | Rate of Dissolution in 0.15% Detergent Solution: Solution Temperature ° C | % of Added DPI Dissolved After Stirring 15 Sec. | 30 Sec. | 60 Sec. | 120 Sec. |
|---|---|---|---|---|---|---|---|---|---|---|---|
| None | 0 | 26.9 | 1.5 | 45.2 | 0 | 26.3 | 20 | — | 13 | 13 | 20 |
| | | | | | | | 50 | — | 37 | 57 | 85 |
| None | 0 | 14.4 | 0.8 | 60.6 | 0 | 24.2 | 20 | — | 14 | 17 | 29 |
| | | | | | | | 50 | — | 46 | 66 | 90 |
| $Na_2SO_4$ | 4.9 | 17.5 | 1.0 | 25.1 | 37.7 | 13.8 | 20 | 88 | 94 | 96 | 98 |
| | | | | | | | 50 | 98 | 99 | 99 | 100 |
| $Na_2SO_4$ + $MgSO_4 \cdot 6H_2O$ | 2.0 1.9 | 9.8 | 0.5 | 22.8 | 53.2 | 9.7 | 20 | 95 | 96 | 98 | 98 |
| | | | | | | | 50 | 97 | 99 | — | — |
| $Na_3C_6H_5O_7 \cdot 2H_2O$ | 3.2 | 9.0 | 0.5 | 24.7 | 49.2 | 13.4 | 20 | 74 | 81 | 97 | 98 |
| | | | | | | | 50 | 99 | 100 | 100 | 100 |
| $NaH_2PO_4 \cdot H_2O$ | 3.0 | 8.5 | 0.5 | 24.4 | 52.8 | 10.8 | 20 | 80 | 95 | 98 | 98 |
| | | | | | | | 50 | 99 | 100 | 100 | 100 |
| $NaHSO_4 \cdot H_2O$ | 3.2 | 9.3 | 0.5 | 24.4 | 49.5 | 13.1 | 20 | 87 | 92 | 96 | 100 |
| | | | | | | | 50 | 99 | 99 | 100 | 98 |
| $KHSO_4$ | 2.8 | 9.1 | 0.5 | 24.5 | 50.7 | 12.4 | 20 | 87 | 94 | 97 | 98 |
| | | | | | | | 50 | 99 | 99 | 100 | 100 |
| $K_2SO_4$ | 2.8 | 9.1 | 0.5 | 24.1 | 50.5 | 13.0 | 20 | 97 | 98 | 99 | 99 |
| | | | | | | | 50 | 99 | 99 | 100 | 100 |
| $Na_2SO$ + $MgSO_4 \cdot 6H_2O$ | 1.5 2.8 | 9.7 | 0.5 | 24.2 | 49.8 | 11.4 | 20 | 94 | 97 | 98 | 99 |
| | | | | | | | 50 | 99 | 99 | 99 | 99 |
| $Na_2SO_4$ + $MgSO_4 \cdot 6H_2O$ | 1.0 0.9 | 9.5 | 0.5 | 24.3 | 51.7 | 12.1 | 20 | 95 | 98 | 99 | 99 |
| | | | | | | | 50 | 98 | 99 | 99 | 100 |
| $Na_2SO_4$ + $MgSO_4 \cdot 6H_2O$ | 0.7 1.3 | 9.0 | 0.5 | 24.3 | 53.0 | 11.2 | 20 | 94 | 98 | 98 | 98 |
| | | | | | | | 50 | 98 | 99 | 100 | 100 |
| $Na_2SO_4$ | 7.9 | 12.8 | 0.7 | 25.3 | 41.3 | 12.0 | 20 | 94 | 97 | 98 | 99 |
| | | | | | | | 50 | 99 | 99 | 99 | 100 |
| $MgSO_4 \cdot 6H_2O$ | 9.3 | 17.0 | 0.9 | 48.6 | 0 | 24.2 | 20 | 84 | 83 | 84 | 90 |
| | | | | | | | 50 | 96 | 99 | 100 | 100 |

[1]Assumes that all of the dispersing agent remained in the core and that no free water (only water of hydration) remained in the core after encapsulation.
[2]DPI = Diperisophthalic Acid
[3]IPA = Isophthalic Acid

EXAMPLE II

Two encapsulated diperisophthalic acid formulations were prepared for testing in a manner similar to that of example I. Sample A comprised capsules having cores of diperisopthalic acid accounting for 26.9 weight percent of the capsules. The cores also contained isophthalic acid accounting for 1.8 percent of the capsules. These cores were encapsulated with a coating of $MgSO_4$ and $H_2O$ which accounted for 45.2 and 26.1 weight percent of the capsules, respectively. Sample B was prepared in a similar manner with the cores containing $MgSO_4.6H_2O$, diperisophthalic acid and isophthalic acid accounting for 9.5, 17.3 and 0.8 weight percent of the capsules, respectively. The cores of Sample B were encapsulated with a coating of $MgSO_4$, solved at a substantially faster rate than the unaltered diperisophthalic acid both at 20° C. and 50° C.

EXAMPLE III

This example illustrates the preparation of bleaching formulation in the form of encapsulated cores having good rates of solubility after exposure to temperature fluctuation.

The encapsulation of diperisophthalic acid cores was run in an 8 quart (7.56 liter) Patterson-Kelly twin shell blender (Model No. LB-4402). The blender was equipped with liquid dispersion disks to provide droplets of core-forming slurry. Droplets of DPI slurry containing various amounts of $MgSO_4$ and different crystal habits of DPI were dispersed into an agitated bed of $MgSO_4.H_2O$ to effect encapsulation. The resulting encapsulated core bleaching formulation was heat treated in the manner shown in Table 2. Table 2 displays starting materials, experimental conditions and test results. From Samples 1 to 3, it appears that diperisophthalic acid cores (containing $MgSO_4$ dispersing agent) which originate and remain acicular in form and habit maintain good water solubility rates. From Samples 2, 2*a*, 2*b*, and 2*c*, it appears that DPI cores (containing $MgSO_4$ (dispersing agent) which originate and remain in tabular habit and form maintain good water solubility rates. Samples 1*a*, 1*b*, 1*c*, 1*d*, 1*e*, 1*f* and 3*a* are bleaching formulations of diperisophthalic acid cores (containing $MgSO_4$ dispersing agent) which originate in acicular form and habit and change to tabular form upon heating. This welded habit of the tabular form DPI is associated with the poor solubility rates shown in Table 2. It is also notable that in the environment of the relatively anhydrous encapsulated core (as distinguished from a water slurry of DPI) the conversion of acicular to tabular crystal proceeds at relatively low temperatures (e.g., 35° C.).

TABLE 2

| Sample No. | Initial Crystal Form and Habit of DPI in Core | Heat Treatment[1] | Effect of Temperature on the DPI Crystal in Encapsulated DPI and Solution Rate: DPI Crystal Form[2] After Heating | Wt. % DPI | Wt. % $MgSO_4$ | Wt. % $H_2O$ | Solubility[4] Rate Dissolved at 20° C. in 1 Min. |
|---|---|---|---|---|---|---|---|
| 1 | Acicular | None | Acicular | 24 | 48 | 27 | 96 |
| 1 a | Acicular | 58° C.-1 hr. | Tabular | 24 | 49 | 26 | 19 |
| 1 b | Acicular | 43° C.-1 hr. | Acicular + Tabular | 24 | 49 | 25 | 83 |
| 1 c | Acicular | 46° C.-2 hr. | 30% Tabular | 24 | 49 | 26 | 53 |
| 1 d | Acicular | 46° C.-3 hr. | 50% Tabular | 24 | 49 | 25 | 52 |
| 1 e | Acicular | 35° C.-3 hr. | 5% Tabular | 24 | 50 | 25 | 86 |
| 1 f | Acicular | 35° C.-2.8 days | Tabular | 24 | 49 | 25 | 21 |
| 2 | Tabular | None | Tabular | 19 | 57 | 23 | 99 |
| 2 a | Tabular | 60° C.-1½ hr. | Tabular | 19 | 57 | 23 | 98 |
| 2 b | Tabular | 60° C.-2.8 days | Tabular | 20 | 58 | 21 | 97 |
| 2 c | Tabular | 60° C.-3.7 days | Tabular | 19 | 58 | 21 | 97 |
| 3 | Acicular | None | Acicular | 18 | 56 | 25 | 99 |
| 3 a | Acicular | 80° C.- ½ hr. | Tabular | 18 | 55 | 25 | 15 |

[1]Heat in full, closed vials or bottles.
[2]Crystal habit determined by X-ray and microscopy.
[3]$MgSO_4 . H_2O$ and $MgSO_4 . 6H_2O$ found in each sample.
[4]Solubility rates are determined in the manner described in Example I.

Although the present invention has been described with reference to specific details of certain embodiments, it is not intended that such details shall be regarded as limitations upon the scope of the invention herein described except insofar as details are included in the accompanying claims.

We claim:

1. A bleaching formulation in the form of an encapsulated core wherein the core comprises particles consisting essentially of tabular habit diperisophthalic acid in admixture with from 1.0 to 90 weight percent of an ionic dispersing agent selected from the group consisting of hydratable inorganic salts, non-hydratable inorganic salts and organic acids said agent having a water solubility of 4 to 200 grams per 100 grams of water at 15° C. and whose water solutions have a pH below 9, said core having its diperisophthalic acid content present as tabular habit diperisophthalic acid at the time the bleaching formulation is formed and being essentially completely encapsulated with a water dispersible encapsulating material capable, in the absence of free water, of preventing contact of the diperisophthalic acid with substances capable of causing its decomposition.

2. The formulation of claim 1 wherein the dispersing agent, encapsulation material or both is one or more of $MgSO_4$, $Na_2SO_4$, or $Na_2Mg(SO_4)_2$ in their hydrated or unhydrated forms.

3. The formulation of claim 1 wherein the encapsulated core is essentially spherical and has a diameter in the range of from about 0.1 to 5 millimeters.

4. The formulation of claim 1 wherein the dispersible encapsulating material is a hydratable salt.

* * * * *